United States Patent [19]

Maisch et al.

[11] Patent Number: 4,530,329

[45] Date of Patent: Jul. 23, 1985

[54] FUEL INJECTION SYSTEM

[75] Inventors: Wolfgang Maisch, Schwieberdingen; Hermann Nusser, Markgröningen; Klaus-Jürgen Peters, Affalterbach; Willi Strohl, Schwieberdingen, all of Fed. Rep. of Germany

[73] Assignee: Robert Bosch GmbH, Stuttgart, Fed. Rep. of Germany

[21] Appl. No.: 543,653

[22] Filed: Oct. 19, 1983

[30] Foreign Application Priority Data

Dec. 28, 1982 [DE] Fed. Rep. of Germany ..... 3248259
Apr. 22, 1983 [DE] Fed. Rep. of Germany ..... 3314633

[51] Int. Cl.[3] ..... F02M 69/00; F02D 3/02

[52] U.S. Cl. ..... 123/447; 123/458; 123/516; 123/446

[58] Field of Search ..... 123/452, 453, 454, 446, 123/447, 516, 467, 458

[56] References Cited

U.S. PATENT DOCUMENTS

| | | | |
|---|---|---|---|
| 3,946,714 | 3/1976 | Eckert | 123/447 |
| 4,161,934 | 7/1979 | Stompp | 123/446 |
| 4,161,964 | 7/1979 | Greiner | 123/447 |
| 4,227,502 | 10/1980 | Steinwart | 123/452 |
| 4,346,687 | 8/1982 | Bauder | 123/516 |
| 4,353,385 | 10/1982 | Maisch et al. | 123/447 |
| 4,373,490 | 2/1983 | Kinata | 123/452 |
| 4,391,252 | 7/1983 | Jüggle | 123/452 |

FOREIGN PATENT DOCUMENTS

| | | | |
|---|---|---|---|
| 2031996 | 4/1980 | United Kingdom | 123/452 |
| 2042074 | 9/1980 | United Kingdom | 123/452 |

*Primary Examiner*—Carl Stuart Miller
*Attorney, Agent, or Firm*—Edwin E. Greigg

[57] ABSTRACT

A fuel injection system which serves to supply fuel to an internal combustion engine. The fuel injection system includes a metering and quantity distribution valve with regulating valves connected at the output side, which valves can be influenced by the fuel pressure in a differential pressure control line. Communicating with a fuel supply line is a fuel reservoir, which has a flexible diaphragm which is displaceable by the fuel pressure counter to a reservoir spring in a spring chamber. Shortly before the end of the movement of the flexible diaphragm into the spring chamber, a spring plate resting on the flexible diaphragm opens a sealing valve via a stem. The sealing valve rests on the mouth of an outflow line, which leads via a control throttle to the differential pressure control line. A pressure maintenance valve is likewise disposed upstream of the sealing valve, and a line from a pressure limitation valve and a leakage line from the metering and quantity distribution valve discharge between the pressure maintenance valve and the sealing valve. The spring chamber of the fuel reservoir communicates via a return flow line with the fuel container.

10 Claims, 2 Drawing Figures

FUEL INJECTION SYSTEM

BACKGROUND OF THE INVENTION

The invention is based on a fuel injection system for an internal combustion engine having an external ignition.

A fuel injection system is already known which has a diaphragm pressure regulator which simultaneously actuates a sealing valve; and after the shutoff of the internal combustion engine on the one hand a pressure drop is effected to below the opening pressure of the fuel injection valves and on the other hand the return flow lines of the fuel injection system are blocked, so that a further pressure drop on the part of the fuel over a relatively long period and the attended formation of vapor bubbles in the fuel injection system are avoided. Therefore problem-free starting of the engine are assured. The known diaphragm pressure regulator can be realized, however, only at substantial production cost.

OBJECT AND SUMMARY OF THE INVENTION

The fuel injection system according to the invention has the advantage over the prior art of lower production costs, as well as greater functional reliability and a compact structure.

By means of the provisions disclosed herein advantageous further developments of and improvements to the fuel injection system disclosed are possible. It is particularly advantageous to dispose a pressure limitation valve on a fuel reservoir and for the fuel which has been reduced in amount via the valve seat of the pressure limitation valve to be carried directly upstream of the sealing valve.

It is likewise advantageous to dispose a pressure maintenance valve upstream of the sealing valve in the outflow line; this valve maintains a predetermined fuel pressure in the outflow line so as to prevent vapor bubble formation in the outflow line when the engine is shut off.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
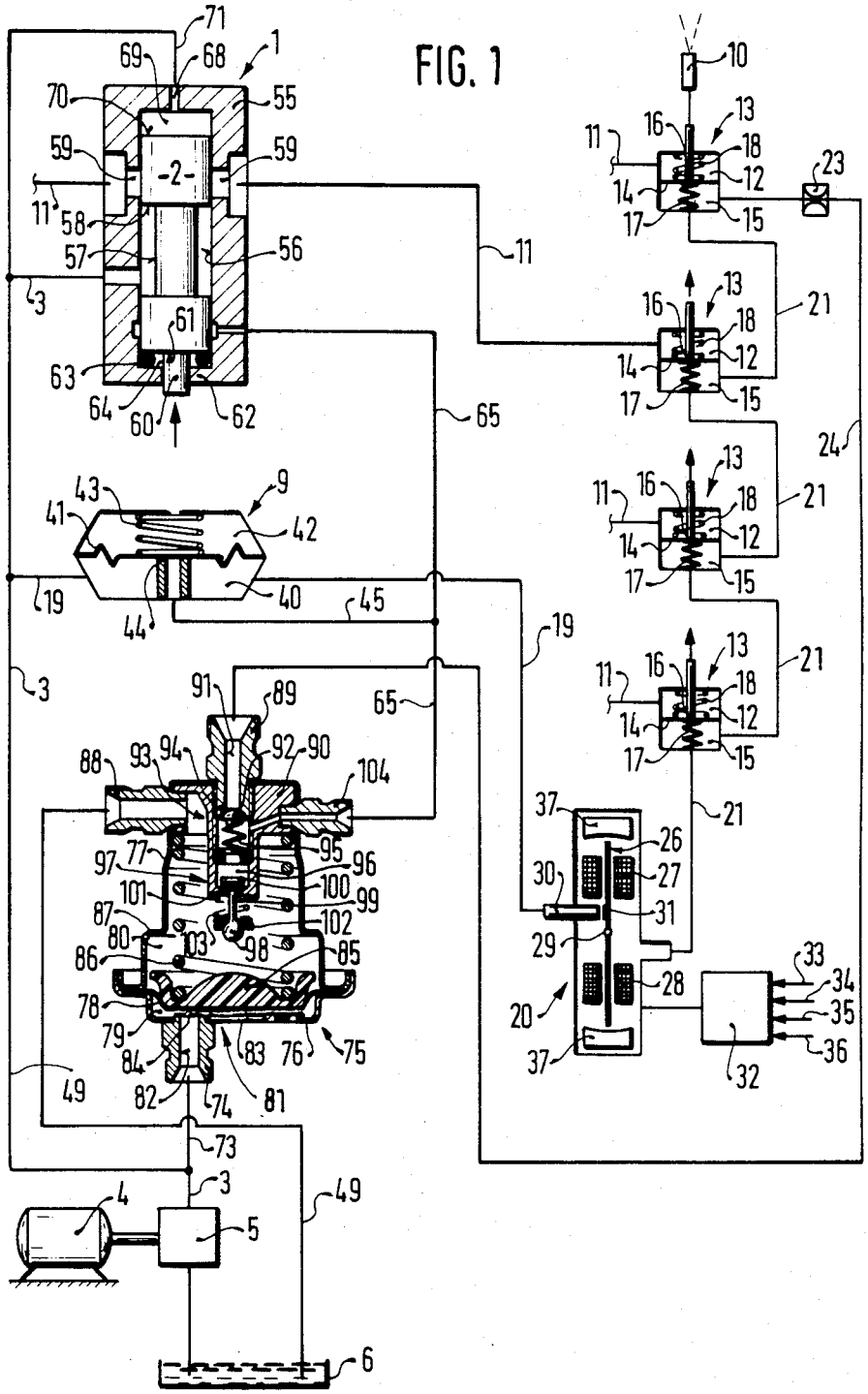
FIG. 1 shows a fuel injection system with a first exemplary embodiment of a fuel reservoir according to the invention and having a sealing valve.

In the exemplary embodiment of a fuel injection system shown in FIG. 1, a metering and quantity distribution valve 1 is shown, with one metering valve opening being associated with each cylinder of a mixture-compressing internal combustion engine (not shown) having externally supplied ignition. At the metering valve, a quantity of fuel which is in a specific ratio to the quantity of air aspirated by the engine is metered. The fuel injection system shown by way of example has four metering valve openings, of which two are shown, and is thus intended for a four-cylinder engine. The cross section of the metering valve openings is variable, for instance in common, by means of a control slide 2 serving as a movable metering valve element, in accordance with operating characteristics of the engine, for instance in a known manner in accordance with the quantity of air aspirated by the engine. The metering valve is located in a fuel supply line 3, into which fuel is fed by a fuel pump 5 driven by an electric motor 4. A line 19 branches off from the fuel supply line 3 and leads to a pressure limitation valve 9 for limiting the fuel pressure prevailing in the fuel supply line 3. When this limit is exceeded, fuel flows back to the fuel container 6 via a fuel reservoir 75.

Each metering valve opening has a line 11 connected thereto by way of which the metered fuel passes into a regulating chamber 12 of a regulating valve 13 separately associated with each metering valve opening. The regulating chamber 12 of the regulating valve 13 is divided by a movable regulating valve element such as a diaphragm 14 from a control chamber 15 of the regulating valve 13. The diaphragm 14 of the regulating valve 13 cooperates with an outlet tube 16 having a fixed valve seat on its end in the regulating chamber 12 so that the metered fuel can flow out of the regulating chamber 12 via this valve seat and outlet tube 16 to the individual injection valves 10, only one injection valve being shown in the intake tube of the engine. A differential pressure spring 18 may be disposed in the regulating chamber 12, urging the diaphragm 14 in the opening direction of the regulating valve 13. A closing spring 17 may likewise be disposed in the control chamber 15, the spring force of which is greater than that of the differential pressure spring 18, so that when the engine is shut off the diaphragm 14 is held on the valve seat 16 and will not execute any stroke movement toward the valve seat 16 upon the starting of the engine.

From the fuel supply line 3, the line 19 also leads from the pressure limitation valve 9 to an electrofluidic converter 20 of the nozzle/baffle type and by way of this element 20 discharges into a differential pressure control line 21. The control chambers 15 of the regulating valves 13 are disposed downstream of the electrofluidic converter 20 in the differential pressure control line 21, and a control throttle 23 is disposed downstream of the control chambers 15. Fuel is capable of flowing out of the differential pressure line 21 into an outflow line 24 via the control throttle 23. The electrofluidic converter 20 of the nozzle/baffle type is known per se and will therefore be described here only briefly in terms of its function and operation. The electrofluidic converter 20 includes a rocker 26, upon which a variable moment of deflection is exerted, for instance electromagnetically by means of coils 27, 28, so that it undergoes a certain deflection about a pivot 29. The line 19 discharges at a nozzle 30 in the electrofluidic converter 20 opposite a baffle plate 31 disposed on the rocker 26. At a constant moment of deflection engaging the rocker 26, a pressure drop is thus produced between the nozzle 30 and the baffle plate 31 which is so great that a constant pressure difference, dependent on the moment of deflection, is established between the fuel pressure in the line 19 and the fuel pressure in the differential pressure control line 21. The triggering of the electrofluidic converter 20 is effected via an electronic control unit 32 in accordance with appropriately entered operating characteristics of the engine such as rpm 33, throttle valve position 34, temperature 35, exhaust gas composition (oxygen sensor) 36 and others. The triggering of the electrofluidic converter 20 by the electronic control unit 32 may be effected either in analog fashion or in clocked increments. In the non-excited state of the electrofluidic converter 20, it is possible by means of suitable spring forces or permanent magnets 37 on the rocker 26 to generate a basic moment such that a pressure difference will assure emergency operation of the engine even if the electrical triggering fails.

In the presence of control signals characterizing engine overrunning, such as an rpm above the idling rpm level with the throttle valve closed, the electrofluidic converter 20 can be excited in such a manner that the fuel pressure in the differential pressure control line 21 increases to such an extent that the regulating valves 13 close, thus precluding fuel injection via the injection valves 10.

The pressure limitation valve 9 has a system pressure chamber 40, which communicates with the fuel supply line 3 via the line 19 and is separated by means of a valve diaphragm 41 from a spring chamber 42, which communicates with either the atmosphere or the intake tube of the engine and in which a system pressure spring 43 is disposed, which urges the valve diaphragm 41 in the closing direction of the valve. A valve seat 44 which cooperates with the valve diaphragm 41 protrudes into the system pressure chamber 40. Fuel flowing out via the valve seat 44 reaches a line 45, which leads into a return flow line 49, and from there the fuel flows to the intake side of the fuel pump 5 via fuel reservoir 75, for instance to the fuel container 6.

The metering and quantity distribution valve 1 has a metering sheath 55, in which the control slide 2 is supported in an axially displaceable manner in a sliding bore 56. The control slide 2 has an annular control groove 57, which is defined on one end by a control edge 58. Upon an upward displacement, the control edge 58 opens a greater or lesser opening extent of the control openings 59, for instance control slits, by way of which fuel can flow out, having been metered in quantity, into the lines 11. With each control opening 59, the control edge 58 of the control slide 2 forms one metering valve, two of which are located in the plane of the drawing and are shown, while the two others, not located in the plane of the drawing, are offset by 90° with respect to the two metering valve openings shown. An air flow rate meter, not shown, may by way of example and in a known manner engage the control slide 2 on the actuation side, on an actuation end 60 so that the air flow rate meter displaces the control slide 2 in accordance with the quantity of air aspirated by the engine which controls the amount of fuel leaving through openings 59. The actuation end 60 has a smaller cross section than the slide body so that a step 61 is formed at the transition. The actuation end 60 is surrounded by and engages a radial wall 62 and thus seals off the sliding bore 56 from below the surrounding medium. An elastic sealing ring 63 is disposed on the radial wall, and in the position of rest of the control slide 2 so that the step 61 comes to rest on this sealing ring 63 and thus effects sealing from the outside. In the operating position of the control slide 2, a leakage space 64 is formed between the step 61 and the radial wall 62 which intercepts the fuel leaking out of the control groove 57 via the outer circumference of the control slide 2 and with which a leakage line 65 communicates. The restoring force on the control slide 2 acting counter to the actuation force acting upon the actuation end 60 is generated by fuel. To this end, the control slide 2 includes an end face 70 which is embodied on the end of the control slide 2 remote from the actuation end 60 and protrudes into a pressure chamber 69 that communicates via a damping throttle 68 with a line 71 which branches off from the fuel supply line 3.

From the fuel supply line 3, a reservoir line 73 also leads to a reservoir fitting 74 of a fuel reservoir 75. The fuel reservoir 75 has a bottom housing formed by a cap 76 and a middle part 77. A flexible diaphragm 78 acting as a yielding reservoir wall is fastened in the overlap between the bottom cap 76 and the middle part 77 in the housing periphery, dividing a reservoir chamber 79 from a spring chamber 80. The reservoir fitting 74 is provided with a bore 82 through which the reservoir line 73 discharges into the reservoir chamber 79, and a check valve 81 is disposed on the cap 76 in the reservoir chamber 79. The spring tongue 83 of the check valve 81 may be secured on the end with the free end of the spring tongue covering the bore 82 on the reservoir fitting 74 and being capable of lifting away from the reservoir fitting 74 in the direction of the reservoir chamber 79. A throttle bore 84 is embodied on the spring tongue 83 in the vicinity of the bore 82. A spring plate 85 rests on the side of the flexible diaphragm 78 oriented toward the spring chamber 80, and a reservoir spring 86 is supported on this spring plate 85. The movement of the flexible diaphragm inward into the spring chamber 80 can be limited by providing that the spring plate 85 come to rest with its peripheral area on a retracted stop collar 87 of the middle part 77. Secured to the middle part 77 is a return flow fitting 88, by way of which the return flow line 49 communicates with the spring chamber 80. The outflow line 24 which communicates via the control throttle 23 downstream of regulating valves 13 with the differential pressure control line 21 leads to an outflow fitting 89 on the middle part 72. A valve body 90 into which the outflow fitting 89 protrudes is disposed in the spring chamber 80 of the middle part 77. The passageway bore 91 of the outflow fitting 89 is closable by a movable valve member 92 of a pressure maintenance valve 93, which cooperates with a valve seat 94 on the outflow fitting 89 and is urged by a compression spring 95 in the direction toward the valve seat 94. The pressure maintenance valve 93 operates counter to a pressure in the outflow line 24 of approximately 1.5 to 2 bar, as a result of which vapor bubble formation is prevented when the engine is shut off. Downstream of the pressure maintenance valve 93, a collecting chamber 96 is formed in the valve body 90, this chamber 96 being defined on the other end by a sealing valve 97. The sealing valve 97 has a stem 98, which protrudes through a discharge opening 99 of the collecting chamber 96 toward the spring chamber 80 and communicates in the collecting chamber 96 with a sealing valve element 100, which cooperates with a valve seat 101 surrounding the discharge opening 99. A closing spring 103 is supported at one end on the stem 98 via a spring plate 102, and on the ther end the closing spring 103 rests on the valve body 90 and urges the sealing valve element 100 in the closing direction of the sealing valve 97. Also discharging into the collecting chamber 96 between the pressure maintenance valve 93 and the sealing valve 97, via a leakage fitting 104 on the part 77, are the line 45 leading from the pressure limitation valve 9 and the leakage line 65 leading from the metering and quantity distribution valve 1.

The function of the fuel reservoir 75 having the pressure maintenance valve 93 and the sealing valve 97 is as follows:

Once the engine has been shut off for a relatively long period, the flexible diaphragm 78 of the fuel reservoir 75 is displaced by the reservoir spring 86, as a result of leakage and volumetric shrinkage in the fuel injection system, into a position in which it rests on the cap 76. The pressure maintenance valve 93 and the sealing valve 97 are then in the closed position. If the engine is now started, then the fuel pump 5 pumps fuel out of the fuel container 6 into the fuel supply line 3 and thus, via the reservoir line 73, to the fuel reservoir 75, whereupon the flowing fuel lifts the spring tongue 83 away from the reservoir fitting 74, so that the fuel can flow virtually unthrottled into the reservoir chamber 79 and fill it; as a result, the flexible diaphragm 78 is displaced into the spring chamber 80 counter to the force of the reservoir spring 86. Shortly before the spring plate 85 comes to rest on the stop collar 87, the spring plate 85 engages the stem 98 and opens the sealing valve 97. The return flow lines 24, 45, 65 from the fuel injection system are thereby opened toward the fuel container 6. If the engine is then shut off, the supply of fuel by the fuel pump 5 is precluded, and via the still-opened sealing valve 97 a rapid drop in the fuel pressure occurs in the system to below the opening pressure of the injection valves 10. From the reservoir chamber 79, fuel can flow out only in a retarded manner via the throttle bore 84 of the spring tongue 83, which is now firmly resting on the reservoir fitting 74. As a result, the flexible diaphragm 78 moves in a retarded manner toward the reservoir chamber 79, until at a pressure of ca. 2.8 to 3.2 bar, determined by the fuel reservoir, the spring plate 85 moves away from the stem 98, and the sealing valve 97 closes all the return flow lines 24, 45, 65 to the fuel container 6. A fuel pressure of ca. 2.8 to 3.2 bar is below the opening pressure of the injection valves 10, so that, as desired no further injection of fuel can take place through these valves 10 nor at a pressure above the fuel vapor pressure at the prevailing fuel temperature, thereby avoiding vapor bubble formation in the fuel injection system which would make engine starting difficult or impossible. A volumetric reduction and any other leakage which might occur from the fuel injection system can be compensated for over a relatively long period by means of the fuel stored in the reservoir chamber 79.

Figure 2:
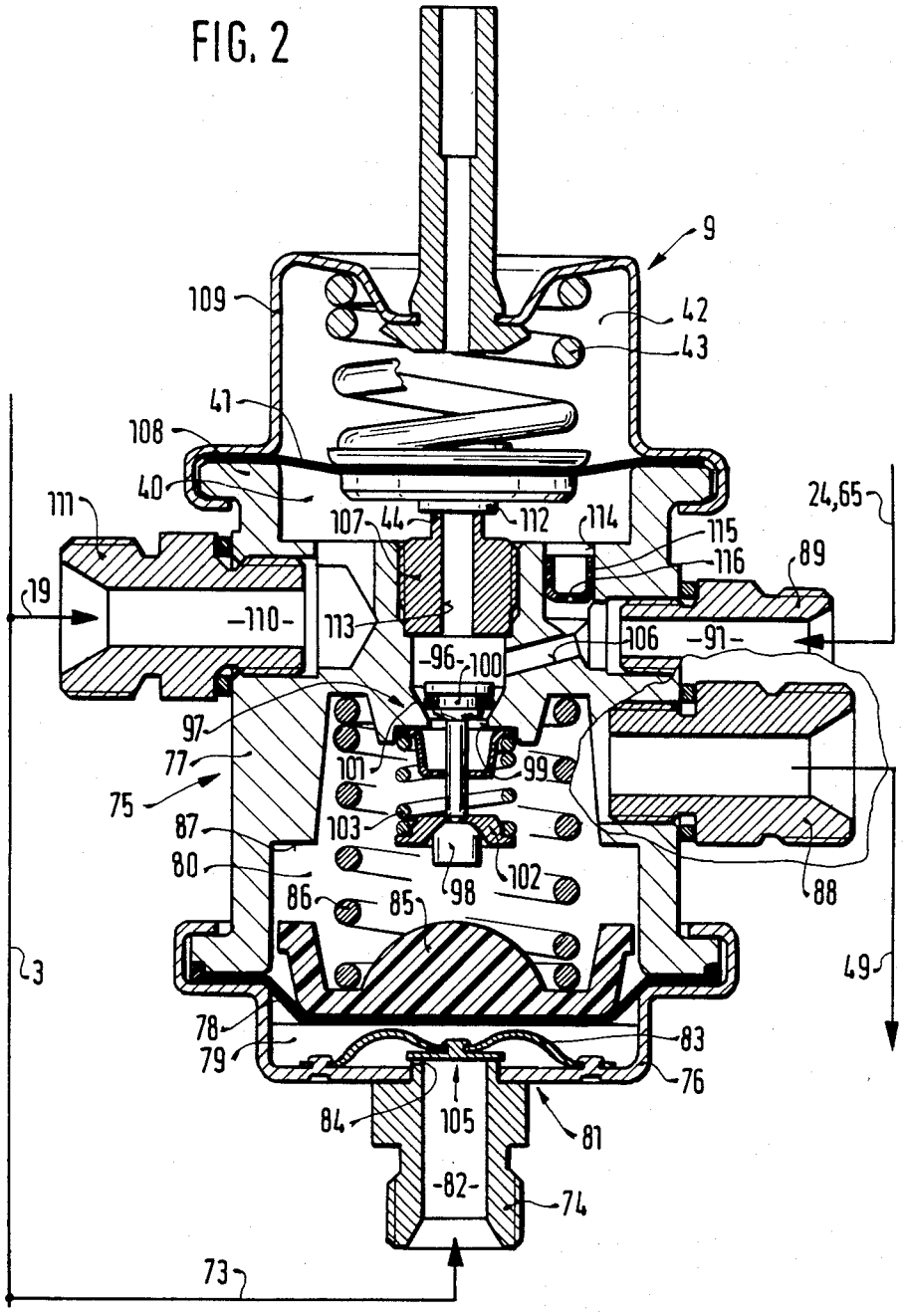
FIG. 2 shows a second exemplary embodiment of a fuel reservoir according to the invention and having a sealing valve and a pressure limitation valve.

FIG. 2, using the same reference numerals as in FIG. 1 for elements having the same function, shows a further exemplary embodiment of a fuel reservoir 75 with a combined pressure limitation valve 9. As in FIG. 1, here again the reservoir line 73 leads from the fuel supply line 3 to the reservoir fitting 74 of the fuel reservoir 75. The fuel reservoir 75 of FIG. 2 again has a housing formed by a cap 76 and a middle part 77, and a flexible diaphragm 78 serving as a yielding reservoir wall is fastened in the periphery of the overlap between the cap 76 and the bottom part 77. This diaphragm 78 divides a reservoir chamber 79 from a spring chamber 80. Via a bore 82 of the reservoir fitting 74, the reservoir line 73 discharges into the reservoir chamber 79, and a check valve 81 with a spring tongue 83 is disposed on the cap 76 in the reservoir chamber 79. The spring tongue 83 has a valve plate 105 covering the bore 82 on the reservoir fitting 74, the valve plate 105 being capable of lifting away from the reservoir fitting 74 in the direction toward the reservoir chamber 79. In the vicinity of the mouth of the bore 82 into the reservoir chamber 79, a throttle bore 84 or throttle slit 84 is embodied on the reservoir fitting 74, as a result of which there is continuous throttled communication between the reservoir line 73 and the reservoir chamber 79. A spring plate 85 on which a reservoir spring 86 is supported rests on the side of the flexible diaphragm 78 oriented toward the spring chamber 80. The movement of the flexible diaphragm 78 into the spring chamber 80 can be limited by providing that the spring plate 85 comes to rest with its periphery on a retracted stop collar 87 of the bottom part 77. A return flow fitting 88, which is shown offset, is secured on the middle part 77, and by way of this fitting 88 the return flow line 49 to the fuel container 6 communicates with the spring chamber 80. The outflow line 24, which communicates via the control throttle 23 with the differential pressure control line 21 (FIG. 1), leads to an outflow fitting 89 on the middle part 77.

The passageway bore 91 of the outflow fitting 89 communicates via a connecting line 106 with the collecting chamber 96 embodied in the middle part 77; the collecting chamber 96 is defined on one end by a valve seat fitting 107 and on the other by a sealing valve 97. The sealing valve 97 has a stem 98, which protrudes through a discharge opening 99 of the collecting chamber 96 toward the spring chamber 80 and is connected in the collecting chamber 96 with a sealing valve element 100, which cooperates with a valve seat 101 surrounding the discharge opening 99. A closing spring 103 is supported via a spring plate 102 on the stem 98, resting on the other end on the valve body 90 and urging the sealing valve element 100 in the closing direction of the sealing valve 97. Also discharging into the collecting chamber 96 upstream of the sealing valve, via the valve seat fitting 107, are the fuel regulated downward by the pressure limitation valve 9 and the leakage line 65 leading from the metering and quantity distribution valve 1.

To this end, the pressure limitation valve 9 is disposed on the middle part 77 of the fuel reservoir 75, in that, remote from the cap 76, a cup-shaped hood 109 is crimped with a ring step 108 of the middle part 77, thereby clamping the valve diaphragm 41 into place. The valve diaphragm 41 divides a system pressure chamber 40 formed on the ring step 108 from a spring chamber 42 formed in the hood 109; this spring chamber communicates with the atmosphere or the intake tube of the engine and a system pressure spring 43 disposed therein urges the valve diaphragm 41 in the closing direction of the valve. The system pressure chamber 40 communicates via a tie line 110 and a connection fitting 111 in the middle part 77 with the line 19 to the fuel supply line 3. Protruding into the system pressure chamber 40 is the valve seat 44 embodied on the valve seat fitting 107 supported in the bottom part 77; the valve seat 44 cooperates with a valve plate 112 secured on the valve diaphragm 41. Fuel flowing out via the valve seat 44 passes into a flow bore 113 of the valve seat fitting 107 which discharges into the collecting chamber 96.

A sheath-like sheet-metal throttle 115 is pressed into place in a bypass line 114 in the middle part 77 and has a relief throttle 116. The bypass line 114 leads from the system pressure chamber 40 to the connecting line 106, so that fuel can flow out of the system pressure chamber 40 in a throttled manner, via the relief throttle 116, to the collecting chamber 96.

The function of the fuel reservoir 75 having the pressure maintenance valve 93 and the pressure limitation valve 9 is as follows:

Once the engine has been shut off for a relatively long period, the flexible diaphragm 78 of the fuel reservoir 75 is displaced by the reservoir spring 86, because of leakages and volumetric reduction in the fuel injection system, into a position in which it rests on the cap 76. The pressure limitation valve 9 and the sealing valve 97 are now in the closed position. If the engine is then started, the fuel pump 5 pumps fuel out of the fuel container 6 into the fuel supply line 3 and thus via the reservoir line 73 as well to the fuel reservoir 75, and the flowing fuel causes the spring plate 105 of the check valve 81 to lift up from the reservoir fitting 74, so that the fuel can flow virtually unthrottled into the reservoir chamber 79 and fill it up, as a result of which the flexible diaphragm 78 is displaced into the spring chamber 80, counter to the force of the reservoir spring 86. Shortly before the spring plate 85 comes to rest on the stop collar 87, the spring plate 85 engages the stem 98 and opens the sealing valve 97. The return flow lines 24, 65, 113 from the fuel injection system are thus opened toward the fuel container 6. If the engine is now shut off, fuel supply by the fuel pump 5 is precluded, and a rapid drop in the fuel pressure in the system takes place via the still-opened sealing valve 97 to below the opening pressure of the injection valves 10, determined by the control throttle 23 and the relief throttle 116. Fuel can flow only in a retarded manner out of the reservoir chamber 79 via the throttle bore 84 when the check valve 81 is closed. As a result, the flexible diaphragm 78 moves in a retarded manner toward the reservoir chamber 79, until at a pressure of ca. 2.8 to 3.2 bar, determined by the fuel reservoir, the spring plate 85 lifts up from the stem 98, and the sealing valve 97 closes all the return flow lines 24, 65, 113 to the fuel container 6. The fuel pressure of approximately 2.8 to 3.2 bar is thus below the opening pressure of the injection valves 10, by way of which in a desired manner no further fuel injection can take place, nor at a pressure above the fuel vapor pressure at the prevailing fuel temperature, as a result of which the formation of vapor bubbles in the fuel injection system, which could make restarting of the engine difficult or impossible, is prevented. A volumetric reduction and any other leakage which may occur from the fuel injection system are compensated for over a relatively long period by means of the fuel stored in the reservoir chamber 79.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection system for internal combustion engines comprising a fuel metering valve located in a fuel supply line, said fuel metering valve including a metering sheath; a plurality of fuel control openings in said metering sheath which are variable in common by a movable control slide displaceable in a sliding bore of said sheath, said control slide including an annular control groove, supply means directing fuel pressure on one end of said control slide and in an area of said annular control groove, a plurality of regulating valves downstream of said fuel metering valve one regulating valve for each said fuel control opening in said metering sheath fuel pressure directed from each said fuel control opening to one side of a movable regulating valve element of each of said regulating valves, each said regulating valve element being subjected to a fuel pressure in a differential pressure control line prevailing on a side opposite to a pressure directed from each said fuel control opening, a fuel reservoir located on the fuel supply line, said fuel reservoir including a yielding reservoir wall including on one side thereof a reservoir chamber, a fuel pressure in the fuel supply line acting one one side of said yielding reservoir wall and a reservoir spring disposed in a spring chamber acting on an opposite side of said reservoir wall counter to said fuel pressure, said spring chamber of said fuel reservoir communicates via a return flow line to a fuel supply container, a sealing valve operable within said fuel reservoir including a movable sealing valve element, said movable sealing valve element protrudes into said spring chamber and is urged in a closing direction by a closing spring, said sealing valve being located at a mouth of an outflow line, which communicates via a control throttle with a differential pressure control line via said regulating valves wherein said sealing valve element is movable by a predetermined movement of said yielding reservoir wall into the spring chamber in the opening direction of said sealing valve.

2. A fuel injection system as defined by claim 1, which includes a pressure limitation valve including a system pressure chamber and a second spring chamber separated by a diaphragm, said system pressure chamber communicates with the fuel supply line, said system pressure chamber of said pressure limitation valve being disposed relative to the fuel reservoir, said system pressure chamber including a valve seat which valve seat is opened to a greater or lesser extent by said diaphragm by way of which fuel can flow out of the system pressure chamber upstream to said sealing valve via said valve seat.

3. A fuel injection valve as defined by claim 2, in which said pressure limitation valve is disposed on said fuel reservoir and said valve seat of said pressure limitation valve is supported by said reservoir and which protrudes into said system pressure chamber of said pressure limitation valve.

4. A fuel injection system as defined by claim 3, in which a relief throttle bypassing the pressure limitation valve is provided from the system pressure chamber to upstream of the sealing valve.

5. A fuel injection system as defined by claim 4, in which the sealing valve is disposed in the fuel reservoir.

6. A fuel injection system as defined by claim 1, in which a pressure maintenance valve is disposed upstream of the sealing valve in the outflow line which opens in the flow direction toward the sealing valve when the fuel pressure in the outflow line is above a predetermined fuel pressure.

7. A fuel injection system as defined by claim 6, in which the sealing valve and the pressure maintenance valve are disposed in the fuel reservoir.

8. A fuel injection system as defined by claim 6, in which a leakage line from said metering valve discharges into the outflow line between the pressure maintenance valve and the sealing valve, in which fuel leaking out of said leakage line at the movable metering valve element and fuel returning from said pressure limitation valve at the fuel supply line is interceptable.

9. A fuel injection system as defined by claim 7, in which a leakage line from said metering valve discharges into the outflow line between the pressure maintenance valve and the sealing valve, in which fuel leaking out of said leakage line at the movable metering valve element and fuel returning from said pressure limitation valve at the fuel supply line is interceptable.

10. A fuel injection system as defined by claim 1, in which a check valve is provided on the fuel reservoir, opens toward the reservoir chamber and is capable of experiencing a flow around through said check valve via a throttle restriction.

* * * * *